US011491359B2

(12) United States Patent
Harker

(10) Patent No.: US 11,491,359 B2
(45) Date of Patent: Nov. 8, 2022

(54) PORTABLE EXERCISE BAR

(71) Applicant: Shon L Harker, Clearfield, UT (US)

(72) Inventor: Shon L Harker, Clearfield, UT (US)

( * ) Notice: Subject to any disclaimer, the term of this patent is extended or adjusted under 35 U.S.C. 154(b) by 0 days.

(21) Appl. No.: 17/338,887

(22) Filed: Jun. 4, 2021

(65) Prior Publication Data

US 2021/0379435 A1 Dec. 9, 2021

Related U.S. Application Data

(60) Provisional application No. 63/035,067, filed on Jun. 5, 2020.

(51) Int. Cl.

*A63B 1/00* (2006.01)
*A63B 21/16* (2006.01)
*A63B 26/00* (2006.01)

(52) U.S. Cl.

CPC ..... *A63B 1/00* (2013.01); *A63B 21/1645* (2013.01); *A63B 26/003* (2013.01); *A63B 2244/22* (2013.01)

(58) Field of Classification Search

CPC ..... A63B 1/00; A63B 21/1645; A63B 26/003; A63B 2244/22; A63B 2209/10; A63B 2210/50; A63B 21/16–1663; A63B 21/04–0557

See application file for complete search history.

(56) References Cited

U.S. PATENT DOCUMENTS 4,662,629 A * 5/1987 Plovie ..... A63B 21/4035 482/40
5,871,422 A * 2/1999 Elbogen ..... A63B 21/1663 482/40
5,921,904 A * 7/1999 Toups ..... A63B 21/4047 482/121
9,114,273 B2 * 8/2015 Kehoe ..... A63B 21/068
9,283,426 B2 * 3/2016 Robertson ..... A63B 21/4035
9,868,006 B1 * 1/2018 Epler ..... A63B 21/068
10,898,752 B1 * 1/2021 Kehoe ..... A63B 23/03525
2003/0216220 A1 * 11/2003 Rota ..... A63B 21/1645 482/121
2012/0190510 A1 * 7/2012 Wang ..... A63B 21/0023 482/91
2014/0302968 A1 * 10/2014 Velikin ..... A63B 21/068 482/40
2015/0367170 A1 * 12/2015 Robertson ..... A63B 22/20 482/139
2016/0166874 A1 * 6/2016 Sheeler ..... A63B 1/00 482/40
2021/0023413 A1 * 1/2021 Nurge ..... A63B 21/4034

FOREIGN PATENT DOCUMENTS

DE 102020125862 A1 * 4/2022

* cited by examiner

*Primary Examiner* — Nyca T Nguyen

(74) *Attorney, Agent, or Firm* — Legends Law Group, PLLC; Stephen H. Bean, Esq.

(57) ABSTRACT

A portable exercise bar is provided. The bar is particularly suited to individuals wishing to obtain balance and positional support during an exercise routine, especially routines involving the lifting and balancing of the user's legs. The bar is useful for practicing ballet and dance moves in temporary environments where there is a door that can be used for supporting the device. Thus, the bar is configured for secure, yet removeable, attachment to a common door. Further, the exercise bar of the present invention is lightweight and can be conveniently packed for modern travel needs.

9 Claims, 4 Drawing Sheets

PORTABLE EXERCISE BAR

FIELD OF THE INVENTION

The present invention relates to a portable exercise bar. The bar is particularly useful for individuals wishing to practice ballet and dance exercise at home or on the go. The portable exercise bar is designed for easy attachment to and removal from a standard door without requiring permanent modifications to the door or otherwise causing unsightly marks or damage to the door. Further, the portable exercise bar is lightweight and easy to install and uninstall. For individuals who travel or want a simpler solution to costly, permanent installations, the present device is a convenient and cost-effective alternative. The invention described herein is useful in home gyms, hotel rooms, offices, garages, and any other location with a common door. The field of the invention encompasses but is not limited to athletic training equipment, personal exercise equipment, and equipment for dance and ballet studios.

BACKGROUND OF THE INVENTION

It is quite common for people engaged in dance, ballet, barre exercises, Pilates® exercises, and general fitness movements requiring position and strength to use a bar or railing for maintaining balance. In addition to helping a person to keep balanced, a bar or railing also provides a place for a person to perform elevated stretches of a leg or arm. The bar or railing also provides a point for rest or relaxation between exercise routines.

Traditionally, the exercise bar or railing is permanently installed on the wall around the edge of a room. However, such an arrangement is not only costly and requires a dedicated space but it is complexly unamenable to semi-permanent uses and travel situations. Although there are prior art configurations for non-wall based bars or railings, these solutions suffer from numerous disadvantages, including that they are heavy, cumbersome, and difficult to set up. For example, U.S. Pat. No. 9,295,866 to Kwo discloses a portable ballet bar exercise device that utilizes an oversized base with a braced, hinged pedestal supporting an exercise bar at a single attachment point. Although this device is portable, it is also cumbersome and suffers from a single attachment point that is prone to rotational stresses about the point of attachment, especially when there is a downward pressure at the extremities of the exercise bar. Likewise, U.S. Pat. No. 10,010,735, also to Kwo, discloses a roller-type ballet bar with expandable legs. Although this device is also portable, it is large and cumbersome. Furthermore, this second Kwo device is not easily packed and transported for situations where the user may be travelling via airplane or train, where luggage size is a consideration. The U.S. Patent Application No. 2020/0114190 of Tuller also discloses a portable barre exercise device. Like the Kwo devices, this portable bar demands a large floor footprint and is unwieldy. These prior art devices have unique characteristics for someone desiring a portable ballet bar but they all suffer from being unwieldy, cumbersome, heavy, difficult to set up or inconvenient for light travel.

There exists a need for a portable exercise bar that offers solid support across the length of the bar and is easily packed and set up for non-permanent installations. There further exists a need for a portable exercise bar that is easily moveable and does not require a large floor footprint. In addition, there exists a need for an exercise device that is easily supported both vertically and horizontally on a common door without causing unsightly marks or damage to the door. Finally, there exists a need for a portable exercise bar that is lightweight and easy to pack and transport yet still offers solid functionality across the entire bar without worry about tipping or unbalancing the bar.

SUMMARY OF THE INVENTION

The present invention relates to a portable exercise bar. In particular, the invention relates to a lightweight, portable exercise or ballet bar that a person can use to obtain balance and positional support during an exercise routine, especially routines involving the lifting and balancing of one's legs. In addition, the exercise bar can be securely attached to a common door using lightweight straps that provide securing anchoring in both vertical and horizontal directions. The present device is inherently stable and can be used on any type of common door. The portability of the device avoids the costs and inconvenience of having to install permanent wall-mounted supports in a dedicated exercise room. The portable exercise bar of the present invention is uniquely adapted for travelers because the device is compact and lightweight.

Figure 1:
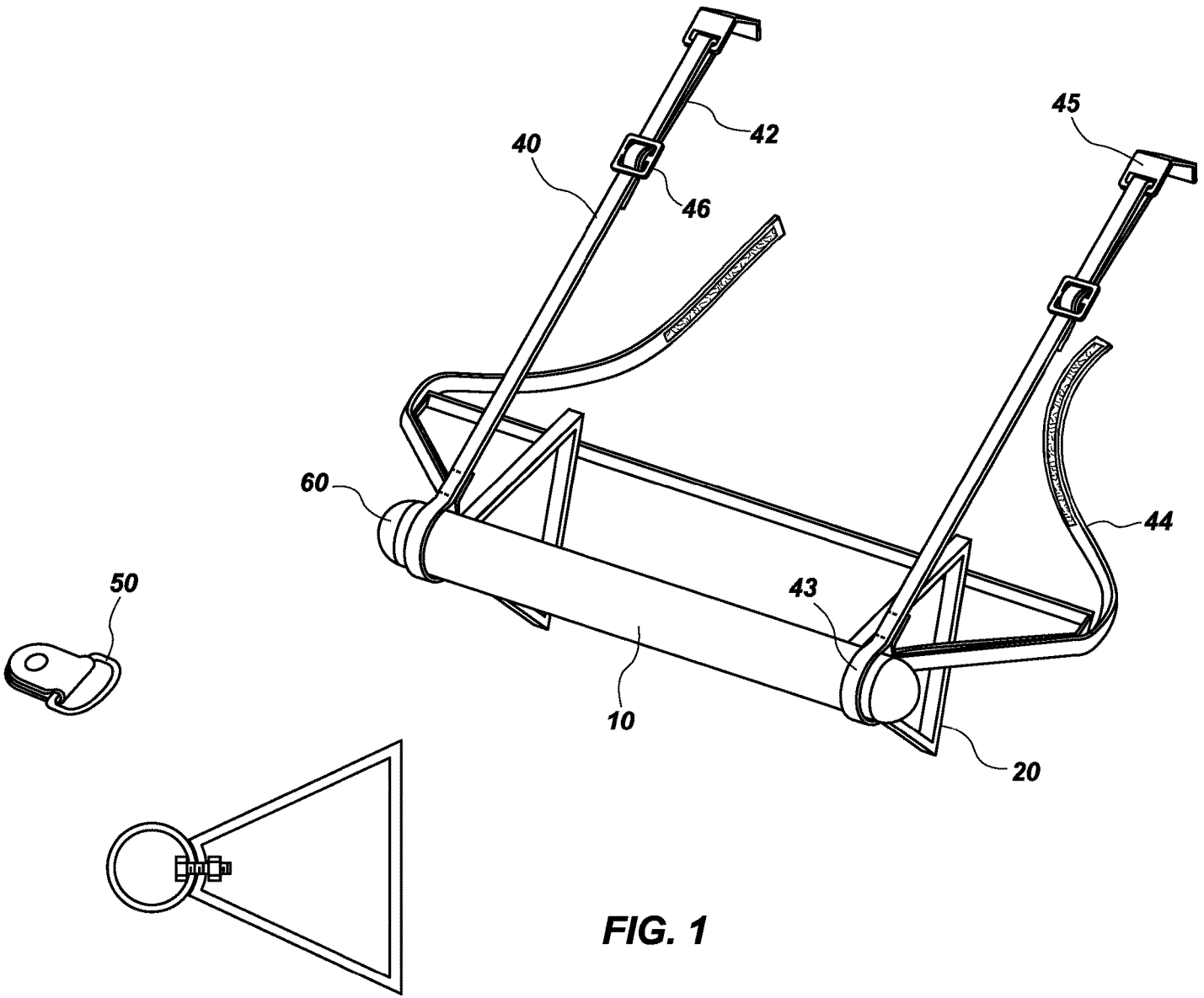
FIG. 1 illustrates a top-right perspective view of the portable exercise bar of the present invention.
Figure 2:
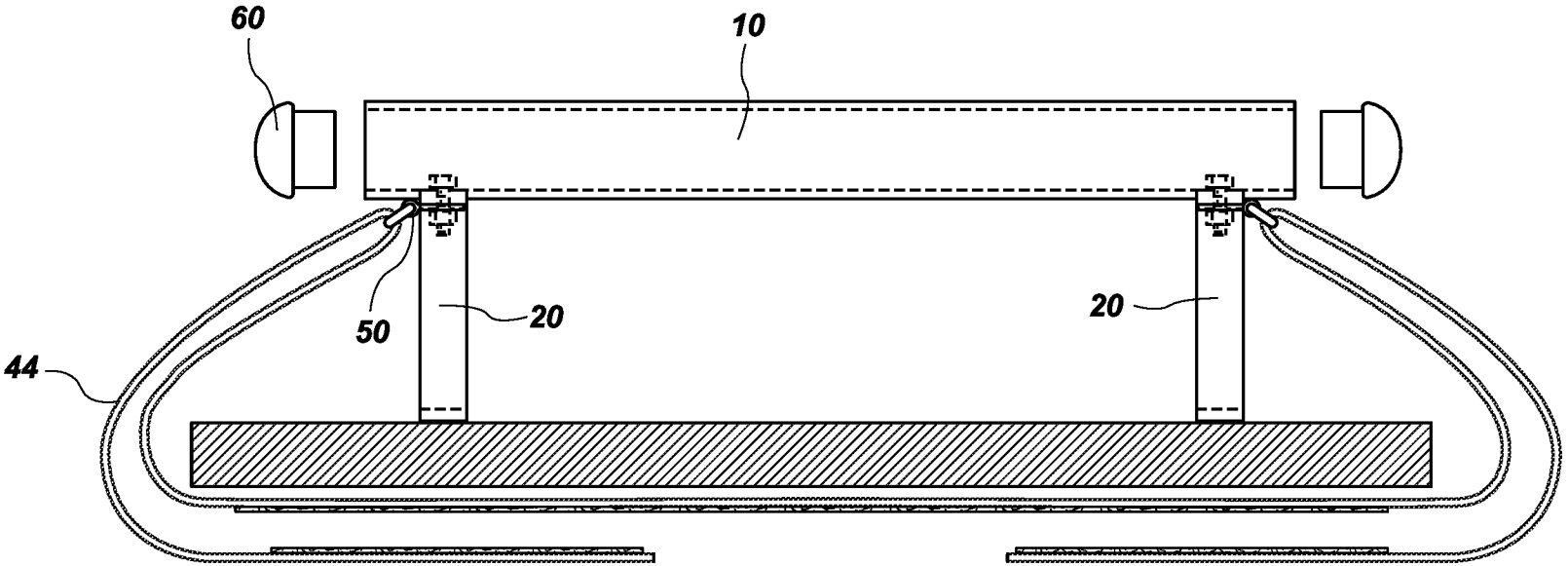
FIG. 2 illustrates a top view of the portable exercise bar of the present invention.
Figure 2:
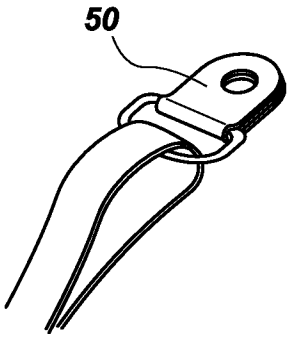

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Reference will now be made in detail to the presently preferred embodiments of the invention. There are also representative examples of the invention illustrated in the accompanying drawings. Throughout the following detailed description, the same reference numeral refers to the same elements in all figures.

The present invention provides a portable exercise bar. In one embodiment of the invention (referring to FIG. 1), there is a balance bar (10) affixed to side brackets (20). Balance bar (10) is rod-shaped and can be made of any material suitably strong enough to support the forces involved in a typical exercise routine, such as wood, steel, aluminum, and modern composite materials. Preferably, bar (10) is formed of a lightweight, hollow aluminum tube. In a preferred embodiment, bar (10) is 26" long or less, which allows the device to be placed on an average sized door without impairing the opening and closing of the door even when the device is installed. If bar (10) is formed in a hollow shape then end caps (60) can be placed into the bar to prevent both the user and the surrounding walls from unwanted damage from the hard edges of the bar. Alternatively, if bar (10) is formed as a solid piece then the ends could be rounded to provide a similar safety feature.

Figure 3:
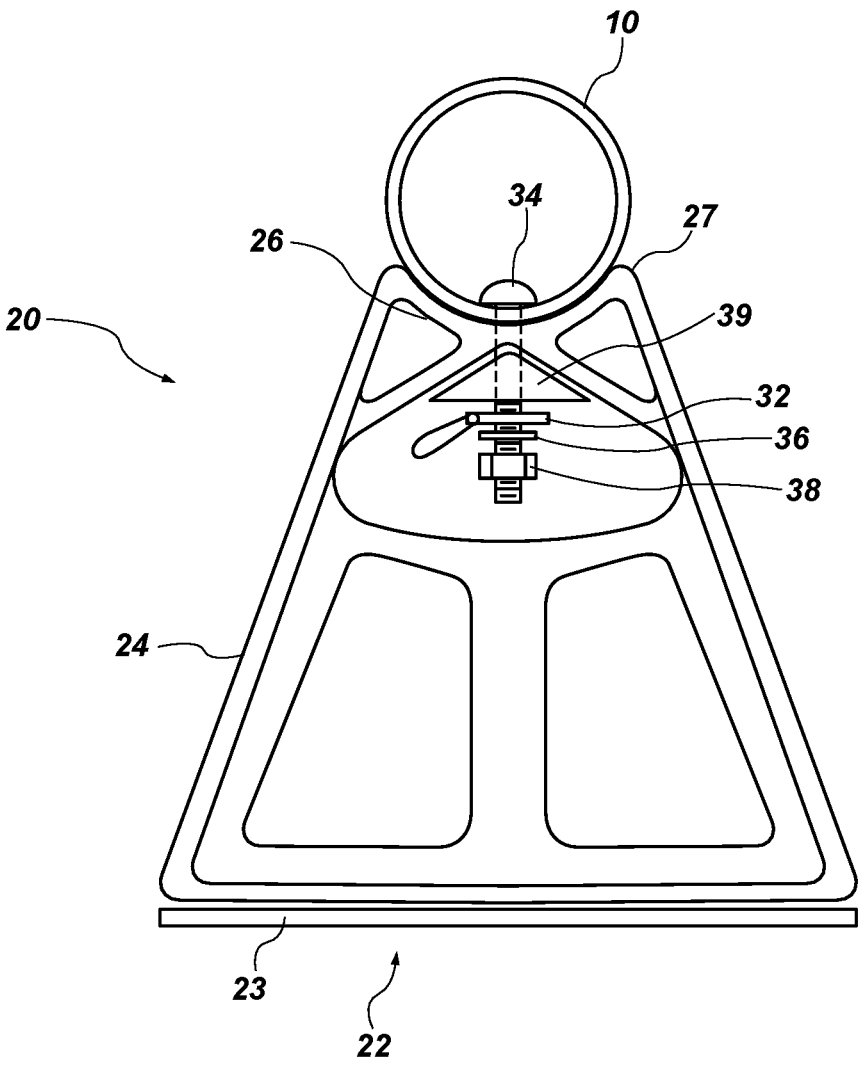
FIG. 3 illustrates a side view of the support bracket of the portable exercise bar of the present invention.

As shown in FIGS. 1 and 3, side bracket (20) has a generally triangular shape that offers sufficient horizontal displacement of bar (10) from the door (not shown) such that the user has room to exercise without striking the door. Bracket (20) can be solid or, preferably, semi-solid, the advantage of the latter configuration being that semi-solid brackets are more lightweight without any structural or functional disadvantages. If provided in triangular form, bracket (20) has a base (22) and sides (24). In one embodiment, top region (26) is a semi-circular indentation shaped to accept a circumferential portion of bar (10) with opposing ridges (27) providing additional partial containment of said bar. In this arrangement, bar (10) can be secured to brackets (20) not only through typical means of connection (as explained, below) but also assisted through the structural form of top region (26). The invention also contemplates anti-slip material (23) being placed on an underside of base (22) to help prevent the device from slipping when installed on the door. In one embodiment, anti-slip material (23) is a 1.0" wide strip of 1/16" thick neoprene.

Bar (10) can be connected to bracket (20) in a number of different ways commonly known to those of skill in the art, such as via glue, bolts, straps, hook-and-loop affixments, and hooks. In a preferred embodiment of the invention, bar (10) is connected to bracket (20) via a pan-head hex screw approximately 1" in length, using an opposing lock washer (36) and hex nut (38). In a preferred embodiment, bracket (20) is formed in a semi-solid design. If the configuration of the semi-solid bracket design does not provide a flat surface for attachment of the screw or bolt (34) and nut (38) then the present invention also contemplates wedge piece (39), which is shaped to provide a flat surface for securely tensioning bar (10) and bracket (20) together via the bolt and nut arrangement. However, the invention also contemplates that bracket (20) may be formed in a manner such that wedge piece (39) is not needed.

Figure 4:
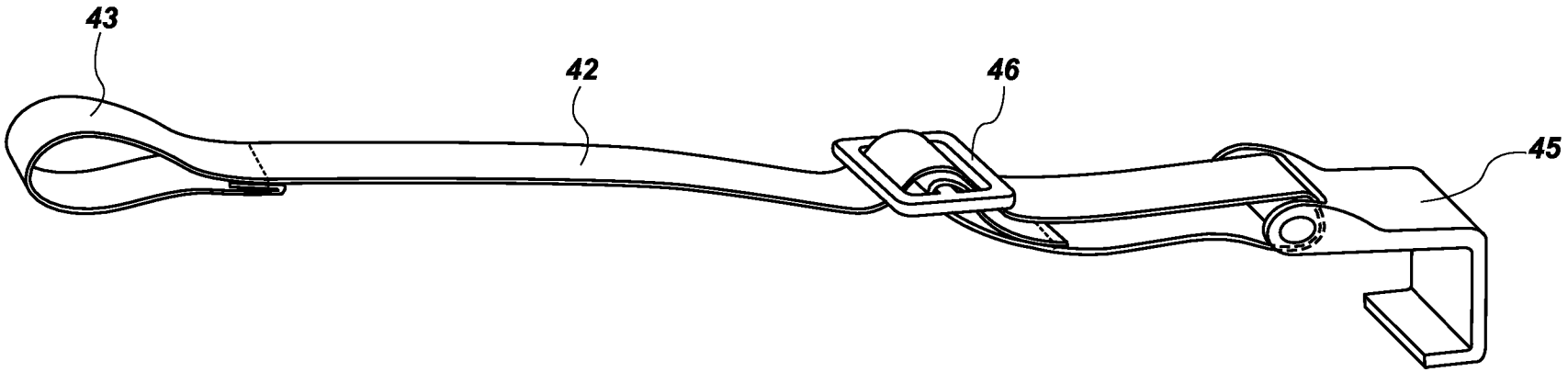
FIG. 4 illustrates a perspective view of a strap and door hook of the portable exercise bar of the present invention.

As depicted in FIG. 1, the portable exercise device of the present invention is secured to a door using vertical straps (42) and horizontal strap (44). Referring to FIGS. 1 and 4, vertical strap (42) comprises a length of strap having a sewn loop (43) on one end and a door bracket (45) on the other end. There is also an adjusting mechanism (46) located therebetween. The end portions of bar (10) extending beyond affixed brackets (20) are connect to support straps (42) via strap loops (43) and door brackets (45) are connected to the top of the opened door. In this manner, portable exercise bar (10) can be easily and quickly suspended onto the door. Adjusting mechanism (46) is then used to set the height of bar (10) a desired distance from the floor. There are many types of adjusting mechanisms that will work with the present invention, including figure-8 brackets, belt and hole arrangements, hook-and-loop affixments, and even tying knots in vertical straps (42). In a preferred embodiment of the invention, adjusting mechanism (46) is a 1" figure-8 bracket and vertical straps (42) are made of 1" strap webbing.

As shown in FIGS. 1 and 4, horizontal strap (44) is a single strap threaded between brackets (20) and the door. To accommodate the threading and horizontal securing of the present device against the door, there is an attachment point (50) provided on each bracket (20). Horizontal strap (44) is preferably made from 1" flat webbing such that the door can be closed without marking or injuring the side door jambs. In a preferred embodiment of the present invention, attachment point (50) is a chaff tab or ring connected to or formed on brackets (20). The ends of horizontal strap (44) have hook-and-loop afffixments such that each side of bar (10) and the corresponding bracket (20) can be secured and then cinched in alternating succession to provide a secure horizontal but temporary affixment of the portable exercise bar to the door.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A portable exercise bar, comprising:

an elongated balance bar having a first end and a second end;

at least two substantially triangular shaped brackets, each bracket having:

a base member;

an upper side member;

a lower side member;

a fastener configured to secure an end of the balance bar to the bracket; and an attachment point;

at least two vertical straps, each vertical strap having:

a loop end configured to receive an end of the balance bar;

a door bracket end configured to secure to a door; and an adjusting mechanism configured to adjust the length of the vertical strap; and a horizontal strap configured to thread between the brackets and the door wherein a first end of the horizontal strap is connected to the attachment point of a first bracket of the at least two substantially triangular shaped brackets and a second end of the horizontal strap is connected to the attachment point of a second bracket of the at least two substantially triangular shaped brackets.

2. The portable exercise bar of claim 1, wherein the balance bar is made of a durable material selected from the group consisting of wood, steel, aluminum, and modern composite materials.

3. The portable exercise bar of claim 1, wherein the balance bar is hollow.

4. The portable exercise bar of claim 3, further comprising end caps disposed in each of the first end and the second end of the balance bar.

5. The portable exercise bar of claim 1, wherein the balance bar is about 26 inches long.

6. The portable exercise bar of claim 1, wherein each bracket further includes a substantially semicircular indentation with opposing ridges opposite the base member and configured to receive a circumferential portion of the balance bar.

7. The portable exercise bar of claim 1, wherein an anti-slip material is disposed on an underside of the base member of each bracket.

8. The portable exercise bar of claim 1, wherein the faster is a nut and bolt assembly.

9. The portable exercise bar of claim 1, wherein the horizontal strap is made from 1-inch flat webbing.

* * * * *